US012256855B2

(12) United States Patent
Jacob

(10) Patent No.: US 12,256,855 B2
(45) Date of Patent: Mar. 25, 2025

(54) LID FOR BEVERAGE CONTAINER

(71) Applicant: BruMate INC., Denver, CO (US)

(72) Inventor: Dylan M. Jacob, Denver, CO (US)

(73) Assignee: BruMate INC., Denver, CO (US)

( * ) Notice: Subject to any disclaimer, the term of this patent is extended or adjusted under 35 U.S.C. 154(b) by 0 days.

(21) Appl. No.: 18/058,472

(22) Filed: Nov. 23, 2022

(65) Prior Publication Data

US 2023/0080131 A1 Mar. 16, 2023

Related U.S. Application Data

(63) Continuation of application No. 17/567,052, filed on Dec. 31, 2021, which is a continuation-in-part of (Continued)

(51) Int. Cl.
*A47G 19/22* (2006.01)
*B65D 43/02* (2006.01)
(Continued)

(52) U.S. Cl.
CPC ..... *A47G 19/2272* (2013.01); *B65D 43/02* (2013.01); *B65D 43/20* (2013.01); *B65D 47/06* (2013.01); *B65D 47/286* (2013.01); *B65D 47/32* (2013.01); *B65D 51/248* (2013.01); *B65D 2251/0018* (2013.01); *B65D 2251/0081* (2013.01); *B65D 2543/00046* (2013.01)

(58) Field of Classification Search
CPC .... A47G 19/22; A47G 19/2205; A47G 19/02; A47G 19/00; A47G 19/2272; A47J 43/27; B65D 43/02; B65D 43/20; B65D 43/22; B65D 47/06; B65D 47/286; B65D 47/28; B65D 47/32; B65D 2251/0018; B65D 2251/0021
See application file for complete search history.

(56) References Cited

U.S. PATENT DOCUMENTS

D424,377 S 5/2000 Wyche
D424,877 S 5/2000 Cayouette
(Continued)

FOREIGN PATENT DOCUMENTS

CA 152541 S 8/2014
CA 162214 S 12/2015
(Continued)

OTHER PUBLICATIONS

Notice of Allowance received for U.S. Appl. No. 29/766,598, mailed on Mar. 6, 2024, 7 pages.
(Continued)

*Primary Examiner* — Javier A Pagan
(74) *Attorney, Agent, or Firm* — Shook, Hardy & Bacon L.L.P.

(57) ABSTRACT

Lid for beverage container. A lid of the present disclosure can include a lid body configured to threadably couple to a container, and a tab assembly hingedly coupled to the lid body, the tab assembly comprising a flip component and a tab component, wherein the flip component is configured to flip from a closed configuration to an open configuration relative to the lid body, and wherein the slide component is configured to slide relative to the flip component so to lock and unlock the slide component upon the lid body.

20 Claims, 17 Drawing Sheets

Related U.S. Application Data application No. 29/766,600, filed on Jan. 15, 2021, now Pat. No. Des. 958,602, and a continuation-in-part of application No. 29/766,601, filed on Jan. 15, 2021, now Pat. No. Des. 1,007,221, and a continuation-in-part of application No. 29/766,598, filed on Jan. 15, 2021, now Pat. No. Des. 1,035,376.

(51) Int. Cl.

| | |
|---|---|
| ***B65D 43/20*** | (2006.01) |
| ***B65D 47/06*** | (2006.01) |
| ***B65D 47/28*** | (2006.01) |
| ***B65D 47/32*** | (2006.01) |
| ***B65D 51/24*** | (2006.01) |

(56) References Cited

U.S. PATENT DOCUMENTS

| | | | | |
|---|---|---|---|---|
| D476,857 | S | | 7/2003 | Holsinger |
| D529,340 | S | | 10/2006 | Laib et al. |
| D613,997 | S | | 4/2010 | Kingsley |
| D692,756 | S | * | 11/2013 | McClellan ..... D9/449 |
| D727,688 | S | | 4/2015 | Hewitt et al. |
| D779,285 | S | | 2/2017 | Seiders et al. |
| D785,405 | S | | 5/2017 | Freeman |
| D805,352 | S | | 12/2017 | Thuma et al. |
| D814,857 | S | * | 4/2018 | Rolfson ..... D9/449 |
| D817,718 | S | | 5/2018 | Furneaux et al. |
| D823,062 | S | | 7/2018 | Goodwin et al. |
| D827,380 | S | | 9/2018 | Tapocik |
| D827,381 | S | | 9/2018 | Boroski |
| D836,395 | S | | 12/2018 | Seiders et al. |
| D836,397 | S | | 12/2018 | Silsby |
| D836,974 | S | | 1/2019 | Seiders et al. |
| D839,049 | S | | 1/2019 | Seiders et al. |
| D839,676 | S | | 2/2019 | Seiders et al. |
| D839,677 | S | | 2/2019 | Seiders et al. |
| D842,038 | S | | 3/2019 | Seiders et al. |
| D843,178 | S | | 3/2019 | Furneaux et al. |
| D844,382 | S | | 4/2019 | Seiders et al. |
| D844,383 | S | | 4/2019 | Seiders et al. |
| D850,209 | S | | 6/2019 | Silsby |
| D850,857 | S | | 6/2019 | Bruner et al. |
| D856,069 | S | | 8/2019 | Barber |
| D863,876 | S | | 10/2019 | Alprin |
| D872,539 | S | | 1/2020 | Hewitt et al. |
| D880,941 | S | | 4/2020 | Silsby et al. |
| D882,343 | S | | 4/2020 | Rane et al. |
| D886,514 | S | | 6/2020 | Kander |
| D886,528 | S | | 6/2020 | Omdahl, II et al. |
| D888,505 | S | | 6/2020 | Seiders et al. |
| D890,573 | S | | 7/2020 | Jacobsen |
| D891,185 | S | | 7/2020 | Cottam |
| D896,575 | S | | 9/2020 | Xie |
| D899,856 | S | | 10/2020 | Jacobsen |
| D901,975 | S | | 11/2020 | Jacobsen |
| D901,988 | S | | 11/2020 | Jacobsen |
| D904,119 | S | | 12/2020 | Jacob |
| D904,125 | S | | 12/2020 | Jacobsen |
| D904,827 | S | | 12/2020 | Stanton |
| D909,818 | S | | 2/2021 | Hunter et al. |
| D911,779 | S | | 3/2021 | Hunter et al. |
| D914,455 | S | | 3/2021 | Haskins |
| D917,955 | S | | 5/2021 | Yao |
| D917,968 | S | | 5/2021 | Silsby |
| D920,048 | S | | 5/2021 | Wang |
| D923,428 | S | | 6/2021 | Haas |
| D925,290 | S | | 7/2021 | Melanson |
| D925,986 | S | | 7/2021 | Kaiser |
| D929,185 | S | | 8/2021 | Omdahl, II et al. |
| D930,435 | S | | 9/2021 | Bruner et al. |
| D931,051 | S | | 9/2021 | Ames |
| D934,633 | S | | 11/2021 | Hunter et al. |
| D935,278 | S | | 11/2021 | Hunter et al. |
| D935,883 | S | | 11/2021 | Wilcox |
| D939,278 | S | | 12/2021 | Vierck |
| D939,279 | S | | 12/2021 | Vierck |
| D941,091 | S | | 1/2022 | Delgado Carmona |
| D947,613 | S | | 4/2022 | Wahl |
| D952,406 | S | | 5/2022 | Wahl |
| D957,884 | S | | 7/2022 | Jacob |
| D958,599 | S | | 7/2022 | Jacob |
| D958,602 | S | | 7/2022 | Jacob |
| D960,645 | S | | 8/2022 | Ji |
| D960,647 | S | | 8/2022 | Yang |
| D968,895 | S | | 11/2022 | Jacob |
| D969,557 | S | | 11/2022 | Jacob |
| D970,968 | S | | 11/2022 | Gu |
| D988,797 | S | | 6/2023 | Jacob |
| D988,798 | S | | 6/2023 | Jacob |
| D1,003,110 | S | | 10/2023 | Jacob |
| D1,003,661 | S | | 11/2023 | Jacob |
| D1,005,775 | S | | 11/2023 | Seiders et al. |
| D1,007,221 | S | | 12/2023 | Jacob |
| 2011/0220670 | A1 | * | 9/2011 | Poole ..... B65D 81/3879 220/739 |
| 2017/0273484 | A1 | * | 9/2017 | Spivey ..... B65D 43/161 |
| 2018/0050848 | A1 | * | 2/2018 | Choltco-Devlin ... B65D 43/267 |
| 2022/0225803 | A1 | | 7/2022 | Jacob |

FOREIGN PATENT DOCUMENTS

| | | |
|---|---|---|
| CN | 306668282 | 7/2021 |
| EP | 006624193-0001 | 7/2019 |

OTHER PUBLICATIONS

Ex Parte Quayle Action received for U.S. Appl. No. 29/766,598, mailed on Nov. 3, 2023, 6 pages.

Final Office Action dated Jun. 23, 2023 in U.S. Appl. No. 29/766,598, 8 pages.

Notice of Allowance dated Jul. 19, 2023 in U.S. Appl. No. 29/766,601, 7 pages.

"Reusable Cup Lid", Pirani, Retreived from internet URL : https://www.pirani.life/collections/pirani-accessories/products/lids, accessed on Nov. 29, 2022, pp. 14 (2020).

"Campy Stainless Steel Travel Mug—Replacement Lid", Ello, Retreived from internet URL: https://www.elloproducts.com/collections/replacement-lids/products/campy-stainless-steel-travel-mug-replacement-lid, accessed on Nov. 29, 2022, pp. 2 (2022).

"Lid for Coffee Tumbler", Otterbox, Retreived from internet URL: https://shop.lifetime.life/lid-for-coffee-tumbler, accessed on Nov. 29, 2022, pp. 2 (2022).

"MultiShaker MUV Lid", Brumate, Retreived from internet URL: https://www.brumate.com/products/multishaker-muv-lid-concrete-gray?, accessed on Nov. 29, 2022, pp. 5 (2022).

Non-Final Office Action dated Dec. 5, 2022 in U.S. Appl. No. 29/766,598, 10 pages.

Non-Final Office Action received for U.S. Appl. No. 17/567,052, mailed on Jun. 14, 2024, 15 pages.

Notice of Allowance received for U.S. Appl. No. 17/567,052, mailed on Oct. 10, 2024, 5 pages.

* cited by examiner

LID FOR BEVERAGE CONTAINER

PRIORITY

This application is a continuation of U.S. application Ser. No. 17/567,052, filed Dec. 31, 2021, and entitled "Lid for Beverage Container" (the "'052 Application"). The '052 Application is a continuation-in-part of U.S. application Ser. No. 29/766,601, filed Jan. 15, 2021. The '052 Application is also a continuation-in-part of U.S. application Ser. No. 29/766,600, filed Jan. 15, 2021. The '052 Application is also a continuation-in-part of U.S. application Ser. No. 29/766,598, filed Jan. 15, 2021. The contents of each of the aforementioned applications are hereby incorporated into the present disclosure directly and by reference in their entirety.

BACKGROUND

Various beverage containers, such as those used to keep a hot beverage hot and a cold beverage cold, are currently available in the marketplace and are sold in various configurations. However, said containers are typically used with lids that don't completely keep the container from spilling liquid contents therein, such as when inverted and shaken.

In view of the foregoing, a container lid, configured for use with a container so that when the lid and the container are coupled to one another and when a beverage is present therein, the container is 100% leakproof when the lid is in a locked configuration, would be well received in the marketplace.

BRIEF SUMMARY

In an exemplary embodiment of a lid for a beverage container of the present disclosure, the lid comprises a lid body configured to threadably couple to a container, and a tab assembly hingedly coupled to the lid body, the tab assembly comprising a flip component and a tab component.

In an exemplary embodiment of a lid for a beverage container of the present disclosure, the flip component is configured to flip from a closed configuration to an open configuration relative to the lid body.

In an exemplary embodiment of a lid for a beverage container of the present disclosure, the slide component is configured to slide relative to the flip component so to lock and unlock the slide component upon the lid body.

In an exemplary embodiment of a lid for a beverage container of the present disclosure, when the lid is threadably coupled to the container and wherein when the slide component is locked relative to the flip component, the container having the lid coupled thereto is 100% leakproof.

In an exemplary embodiment of a lid for a beverage container of the present disclosure, the slide component is configured to slide relative to the flip component so to lock and unlock the slide component upon the lid body.

In an exemplary embodiment of a lid for a beverage container of the present disclosure, when the tab assembly is in a closed configuration and when the slide component is in an unlocked configuration relative to the flip component, the flip component is permitted to flip from a closed configuration to an open configuration and back to the closed configuration.

In an exemplary embodiment of a lid for a beverage container of the present disclosure, when the tab assembly is in a closed configuration and when the slide component is in a locked configuration relative to the flip component, the flip component is prevented from flipping relative to the lid body because the slide component locks the tab in place relative to the lid body.

In an exemplary embodiment of a lid for a beverage container of the present disclosure, the lid further comprises a first magnetically attractive element coupled to or otherwise embedded in the flip component, and a second magnetically attractive element coupled to or otherwise embedded in the lid body, wherein at least one of the first magnetically attractive element and the second magnetically attractive element comprises a first magnet, and wherein the other of the first magnetically attractive element and the second magnetically attractive element not comprising the first magnet can comprise either a metal or a second magnet.

In an exemplary embodiment of a lid for a beverage container of the present disclosure, when the flip component is in an open configuration relative to the lid body, the first magnetically attractive element would be positioned close to, or even touching, the second magnetically attractive element, so that the flip component would remain open when drinking a beverage from the container having the lid coupled thereto.

In an exemplary embodiment of a lid for a beverage container of the present disclosure, at least one of first magnetically attractive element and the second magnetically attractive comprises has indicia positioned thereon or engraved therein.

In an exemplary embodiment of a lid for a beverage container of the present disclosure, the lid body comprises one or more flanges defined therein or otherwise coupled thereto, the one or more flanges located at a relative top of the lid body and configured to aid or otherwise assist a user with securing and removing the lid relative to the container.

In an exemplary embodiment of a lid for a beverage container of the present disclosure, the lid further comprises a threaded portion comprising threads, the threaded portion configured to engage a threaded section of the container.

In an exemplary embodiment of a lid for a beverage container of the present disclosure, the threads have a spiral configuration.

In an exemplary embodiment of a lid for a beverage container of the present disclosure, the threads are configured so to be able to engage the threaded section of the container, so to tighten the lid upon the container, when the lid is rotated clockwise relative to the container and when the lid is rotated counterclockwise relative to the container.

In an exemplary embodiment of a lid for a beverage container of the present disclosure, the flip component comprises a flip lock comprising a lock tab configured to engage an indention defined within the lid body when the flip component is in a closed configuration relative to the lid body.

In an exemplary embodiment of a lid for a beverage container of the present disclosure, the lid further comprises a drink stopper coupled to or formed as part of the flip component, the drink stopper configured to fit within a drink opening so to seal the drink opening when the flip component is in a closed configuration.

In an exemplary embodiment of a lid for a beverage container of the present disclosure, the lid further comprises a vent opening defined therein, the vent opening configured to allow an interior of the container to vent while a user is drinking from the container having the lid coupled thereto In an exemplary embodiment of a lid for a beverage container of the present disclosure, the lid further comprises a vent stopper coupled to or formed as part of the flip component, the vent stopper configured to fit within a vent opening so to seal the vent opening when the flip component is in a closed configuration.

In an exemplary embodiment of a lid for a beverage container of the present disclosure, the lid comprises a lid body configured to threadably couple to a container, a tab assembly hingedly coupled to the lid body, the tab assembly comprising a flip component and a tab component, wherein the flip component is configured to flip from a closed configuration to an open configuration relative to the lid body, wherein the slide component is configured to slide relative to the flip component so to lock and unlock the slide component upon the lid body, wherein when the tab assembly is in a closed configuration and when the slide component is in an unlocked configuration relative to the flip component, the flip component is permitted to flip from a closed configuration to an open configuration and back to the closed configuration, wherein when the tab assembly is in a closed configuration and when the slide component is in a locked configuration relative to the flip component, the flip component is prevented from flipping relative to the lid body because the slide component locks the tab in place relative to the lid body, and wherein when the lid is threadably coupled to the container and wherein when the slide component is locked relative to the flip component, the container having the lid coupled thereto is 100% leakproof.

In an exemplary embodiment of a lid for a beverage container of the present disclosure, the lid further comprises a first magnetically attractive element coupled to or otherwise embedded in the flip component, and a second magnetically attractive element coupled to or otherwise embedded in the lid body, wherein at least one of the first magnetically attractive element and the second magnetically attractive element comprises a first magnet, wherein the other of the first magnetically attractive element and the second magnetically attractive element not comprising the first magnet can comprise either a metal or a second magnet, and wherein when the flip component is in an open configuration relative to the lid body, the first magnetically attractive element would be positioned close to, or even touching, the second magnetically attractive element, so that the flip component would remain open when drinking a beverage from the container having the lid coupled thereto.

BRIEF DESCRIPTION OF THE DRAWINGS

The disclosed embodiments and other features, advantages, and disclosures contained herein, and the matter of attaining them, will become apparent and the present disclosure will be better understood by reference to the following description of various exemplary embodiments of the present disclosure taken in conjunction with the accompanying drawings, wherein.

Figure 1:
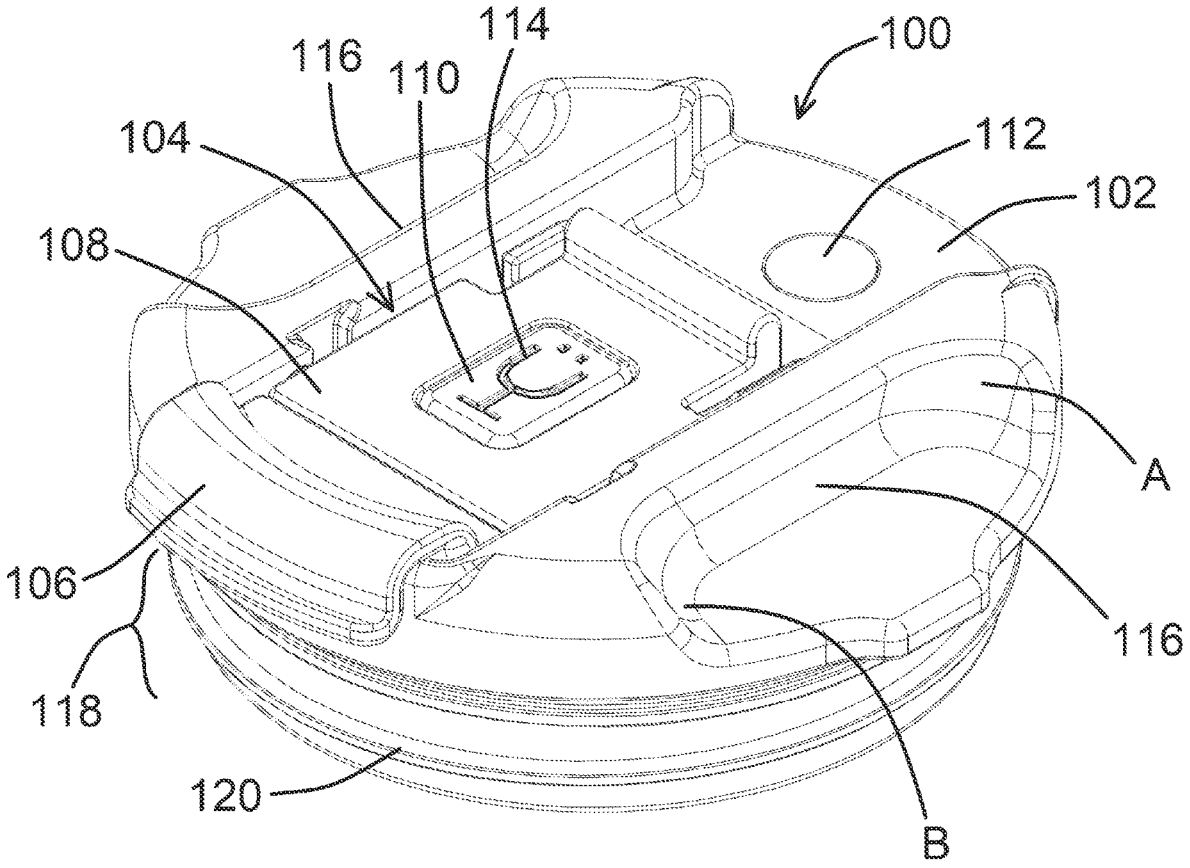
FIG. 1 shows a perspective view of an embodiment of a lid of the present disclosure, according to at least one embodiment of the present disclosure.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 3:
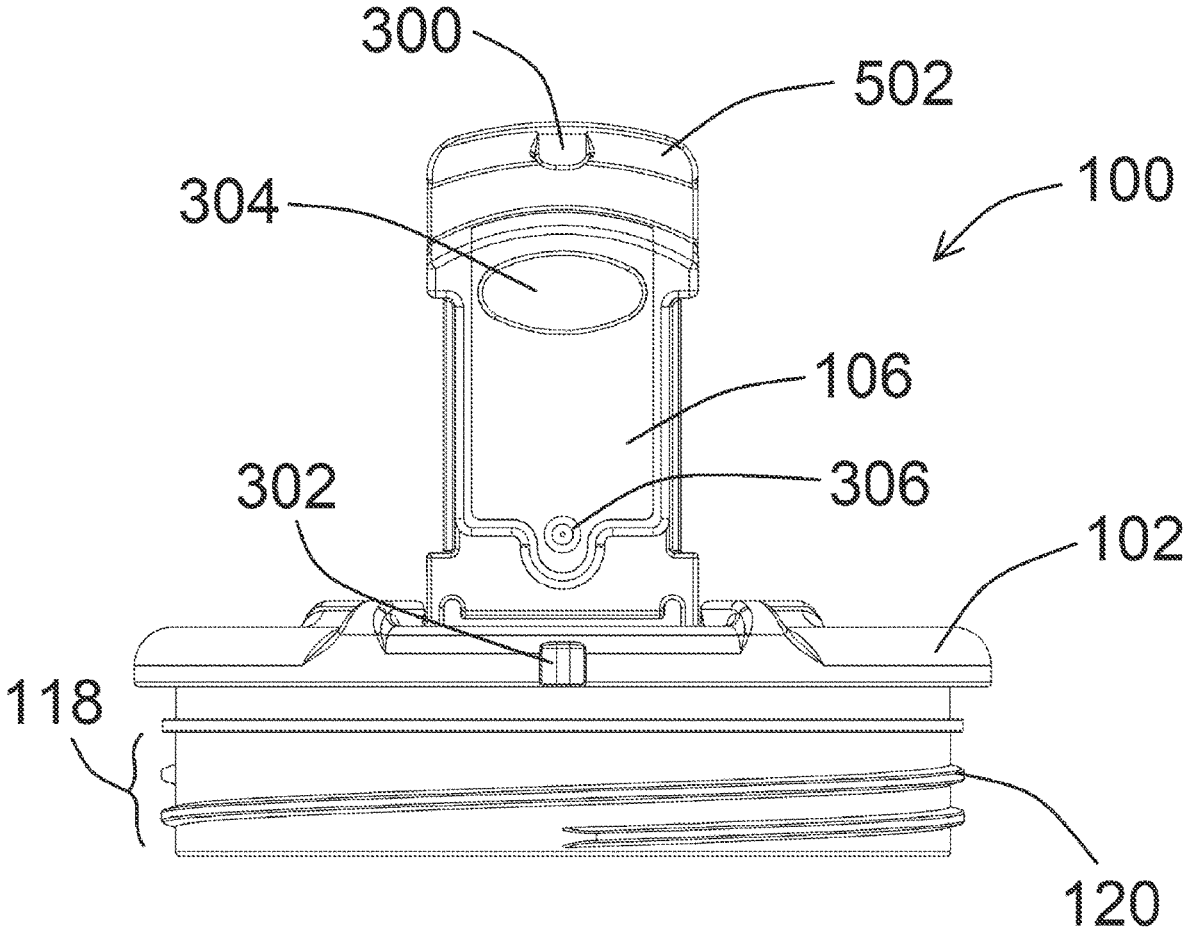
FIG. 3 shows a front view of an embodiment of a lid of the present disclosure with a tab assembly in an open configuration, according to at least one embodiment of the present disclosure.

An exemplary lid of the present disclosure is shown in FIG. 1. As shown in FIG. 1, lid 100 generally comprises a lid body 102 configured to at least partially fit inside a corresponding container (container 200, as shown in FIG. 3). Lid body 102 has several novel features and components resulting in a lid 100 that is truly 100% leakproof.

Figure 2:
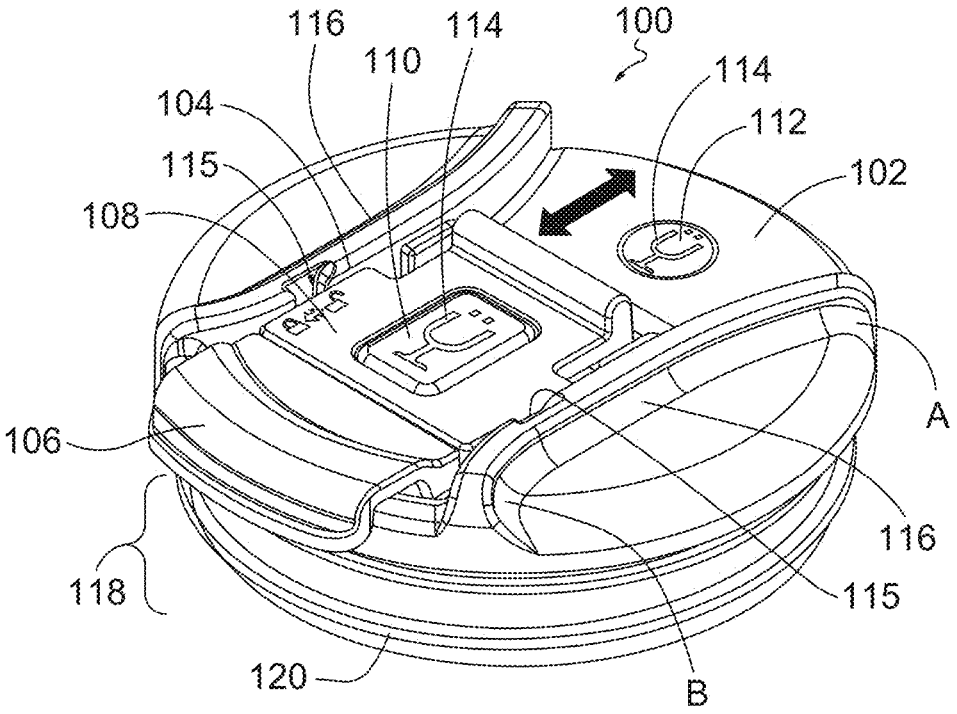
FIG. 2 shows a perspective view of an embodiment of a lid of the present disclosure with a tab assembly in a closed configuration, according to at least one embodiment of the present disclosure.

As shown in FIGS. 1 and 2, lid body 102 comprises a tab assembly 104 hingedly coupled thereto. Tab assembly 104, as shown in FIGS. 1 and 2, comprises a flip component 106 and a slide component 108, whereby flip component 106 permits tab assembly 104 to "flip" from a closed configuration, as shown in FIGS. 1 and 2, to an open configuration, as shown in FIG. 3. Slide component 108, as shown in FIGS. 1 and 2 and with a dual arrow indicating the direction of slide movement in FIG. 2, is configured to slide relative to flip component 106 so to "unlock" and "lock" tab assembly 104 relative to lid body 102. In such an overall configuration, when tab assembly 104 is in a closed configuration and when slide component 108 is in an unlocked configuration relative to flip component 106, flip component 106 is permitted to flip from a closed configuration to an open configuration and back to a closed configuration, for example. Furthermore, and in such a configuration, when tab assembly 104 is in a closed configuration and when slide component 108 is in a locked configuration relative to flip component 106, flip component 106 is prevented from flipping relative to lid body 102, as in such a configuration slide component 108 effectively locks tab 102 in place relative to lid body 102. When locked such as this, lid 100 is truly and completely 100% leakproof when properly coupled to a container 200.

Flip component 106, such as shown in FIGS. 1 and 2, may have a first magnetically attractive element 110 coupled thereto and/or otherwise embedded therein. First magnetically attractive element 110, such as one comprising metal that is attractive to a magnet or itself a magnet, is configured to engage a second magnetically attractive element 112, such as a magnet coupled to lid body 102 and/or otherwise embedded therein. Alternatively, and in various embodiments, first magnetically attractive element 110 could comprise a magnet coupled to flip component 106 and/or otherwise embedded therein, and second magnetically attractive element 112 could comprise metal that is attractive to a magnet or could comprise another magnet. In either described embodiment, when flip component 106 is in an open configuration, first magnetically attractive element 110 would be positioned very close to (or even touching) second magnetically attractive element 112, so that flip component 106 would remain open when drinking a beverage from a container 200 having such a lid 100 coupled thereto. In various embodiments, first magnetically attractive element 110 and/or second magnetically attractive element can have indicia 114 positioned thereon or engraved therein, for example), where said indicia 114 can comprise a logo, name, other word, etc., as may be desired.

Lid bodies 102 of the present disclosure, in various embodiments, can comprise one or more flanges 116 defined therein or otherwise coupled thereto, configured to, for example, aid or otherwise assist a user with securing and removing lid 100 relative to a container 200. For example, a user, when using their left hand to grip and tighten a lid 100 relative to container 200, a user's thumb could press against at least a portion of flange 116 (indicated with an "A" in FIGS. 1 and 2) while twisting lid 100 relative to container 200 in a first direction, and could then use their left hand to grip and remove/loosen said lid 100 relative to container 200 and twist said lid 100 in a second direction opposite the first direction, whereby, for example, the user's thumb could press against at least a different portion of flange 116 (indicated with a "B" in FIGS. 1 and 2). Alternatively, and for example, a user, when using their right hand to grip and tighten a lid 100 relative to container 200, a user's thumb could press against at least a portion of flange 116 (indicated with the "B" in FIGS. 1 and 2) while twisting lid 100 relative to container 200 in a first direction, and could then use their right hand to grip and remove/loosen said lid 100 relative to container 200 and twist said lid 100 in a second direction opposite the first direction, whereby, for example, the user's thumb could press against at least a different portion of flange 116 (indicated with the "A" in FIGS. 1 and 2). Such tightening and loosening of lid 100 relative to container 200 is applicable to a threading configuration (of lid 100 relative to container 200) whereby turning lid 100 clockwise tightens lid 100 and whereby turning lid 100 counterclockwise loosens lid 100.

Figure 4:
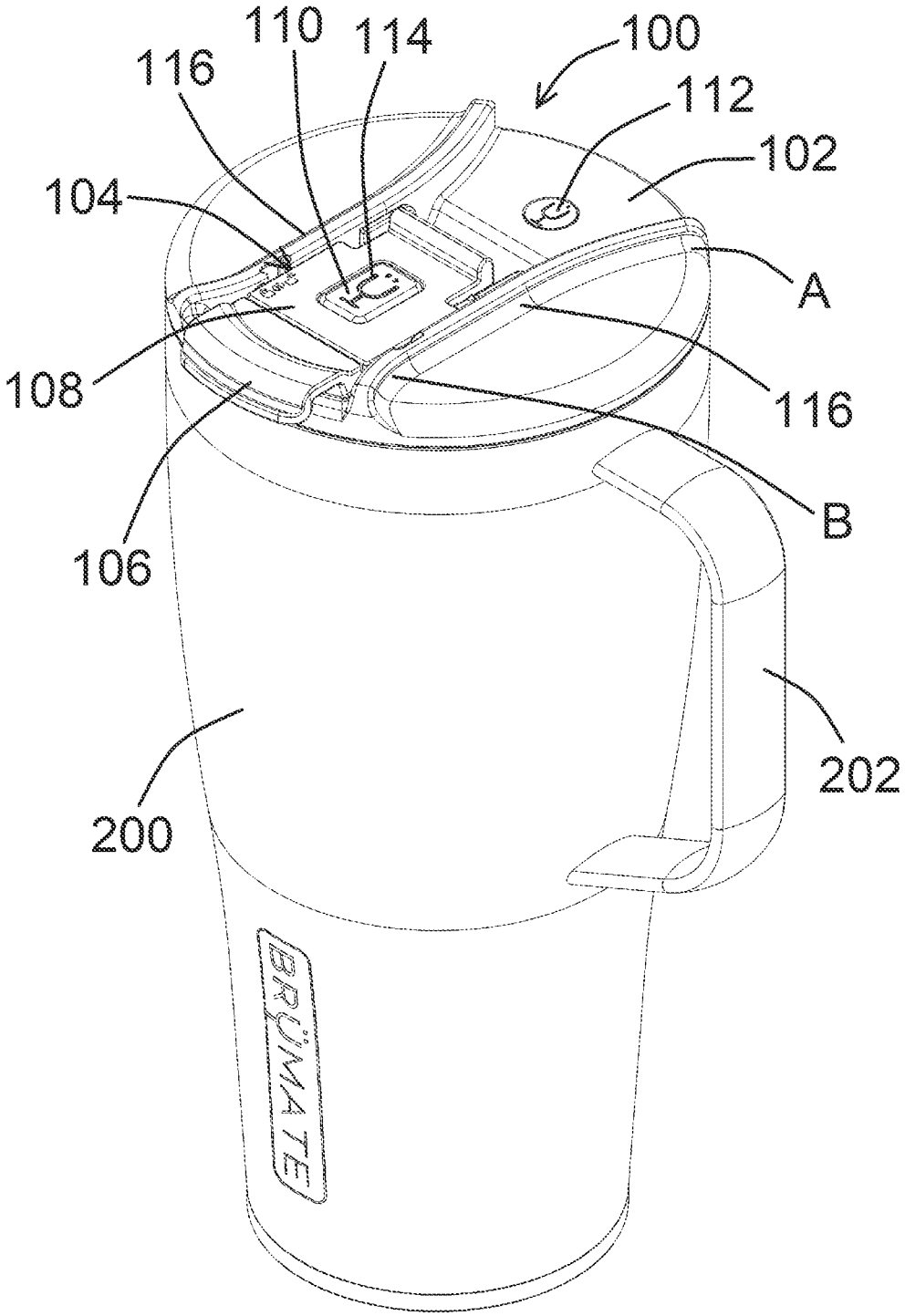
FIG. 4 shows a perspective view of an embodiment of a lid of the present disclosure coupled to an container, according to at least one embodiment of the present disclosure.
Figure 5:
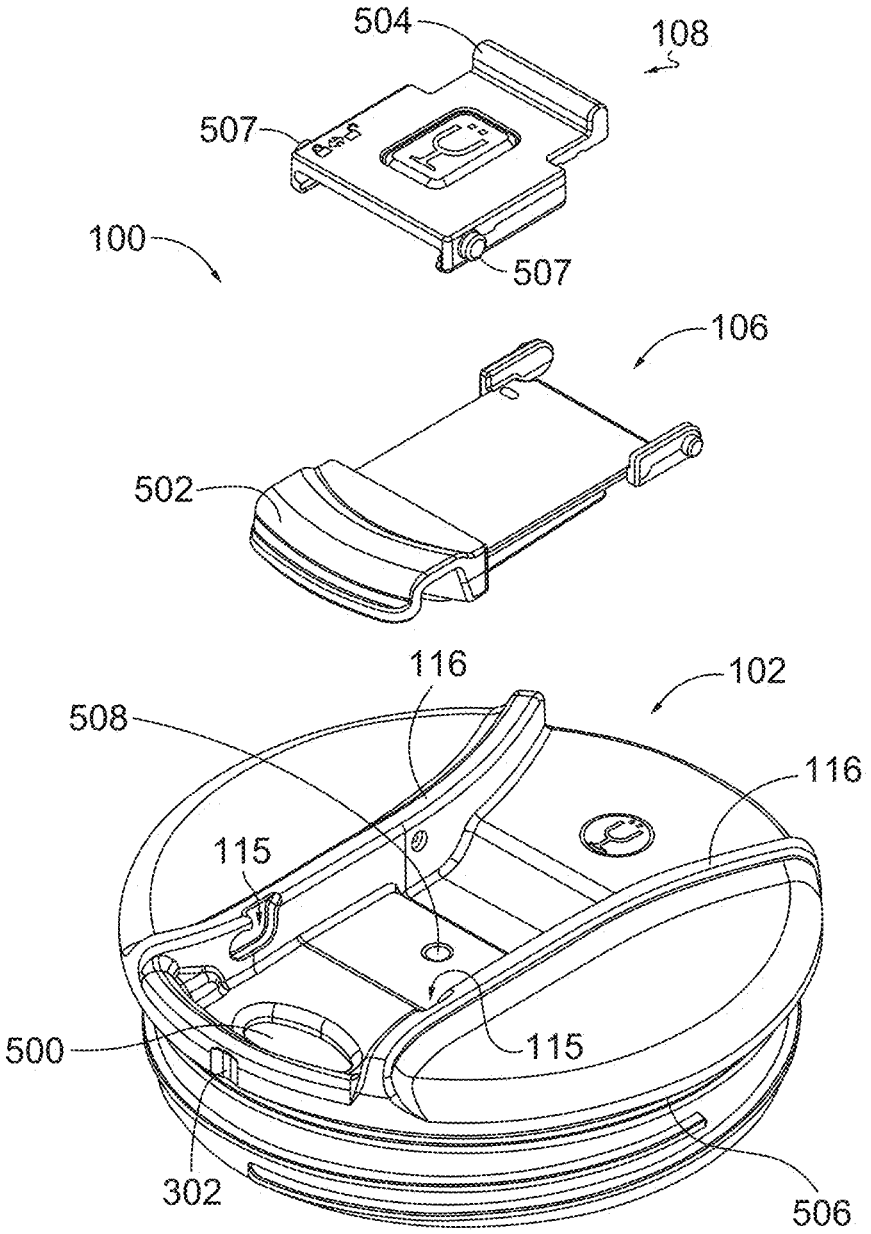
FIG. 5 shows an exploded perspective view of various components of an exemplary lid, according to at least one embodiment of the present disclosure.
Figure 6:
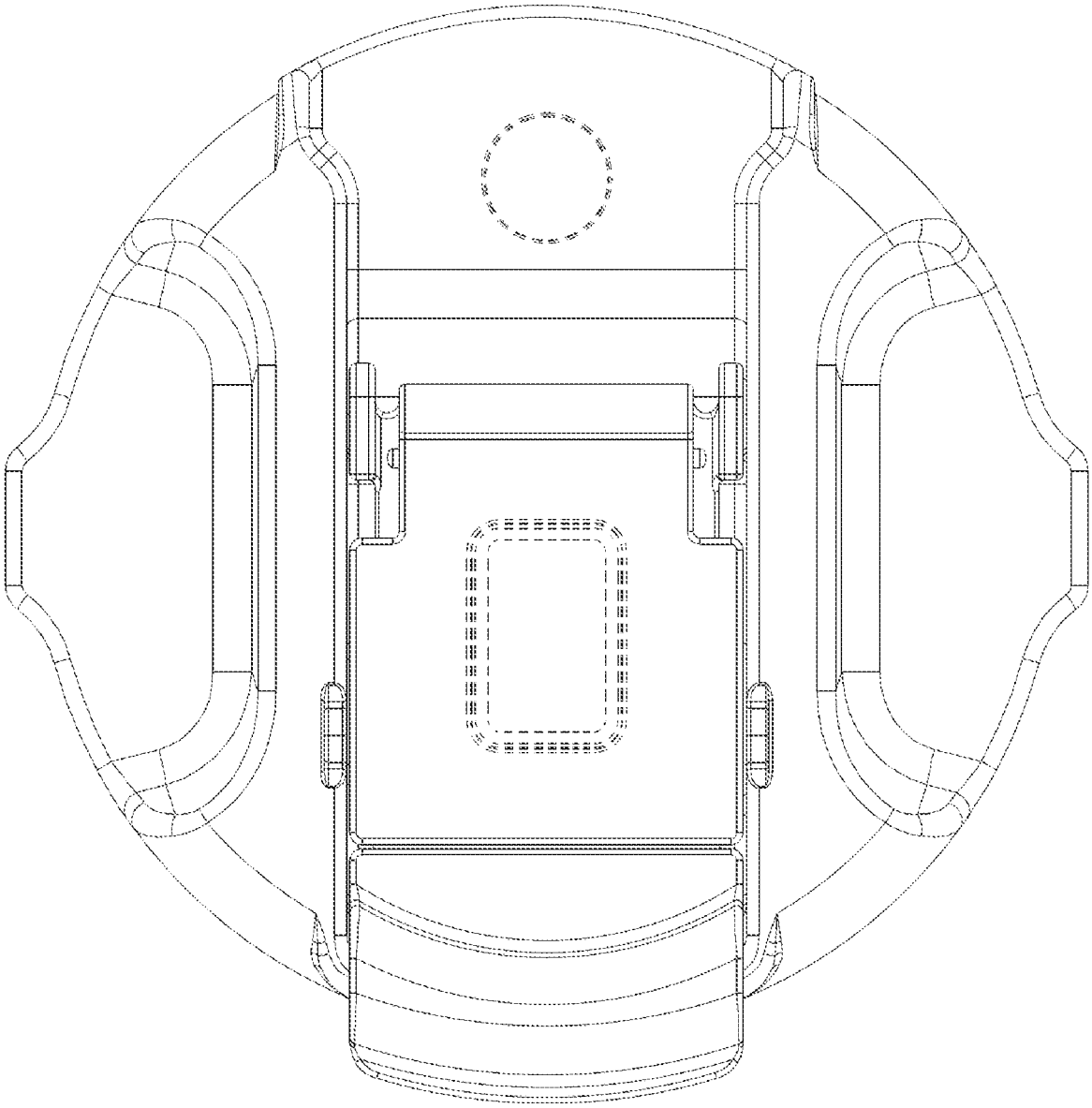
FIG. 6 shows a top view of an embodiment of a lid of the present disclosure, according to at least one embodiment of the present disclosure.
Figure 7:
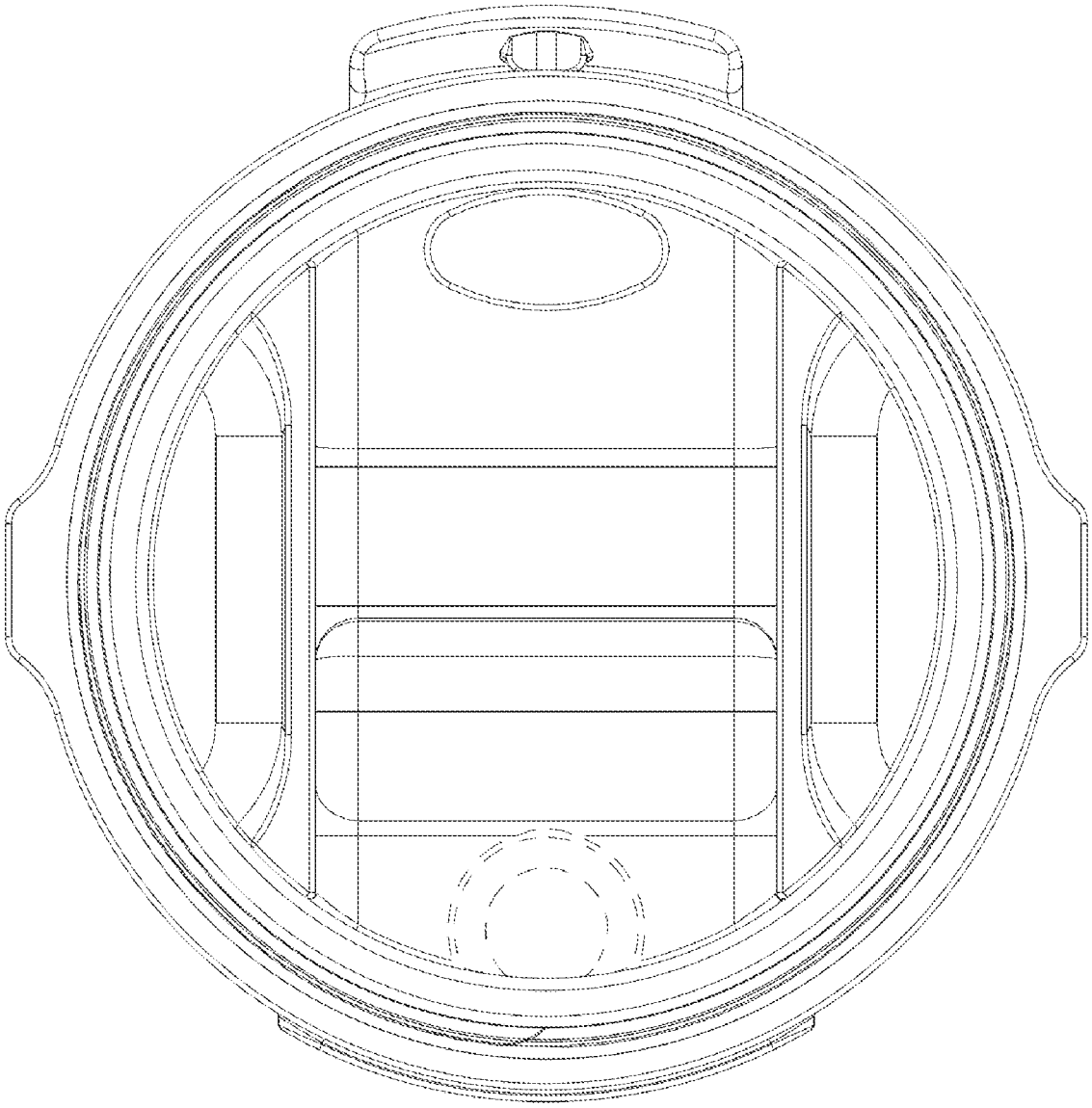
FIG. 7 shows a bottom view of an embodiment of a lid of the present disclosure, according to at least one embodiment of the present disclosure.
Figure 8:
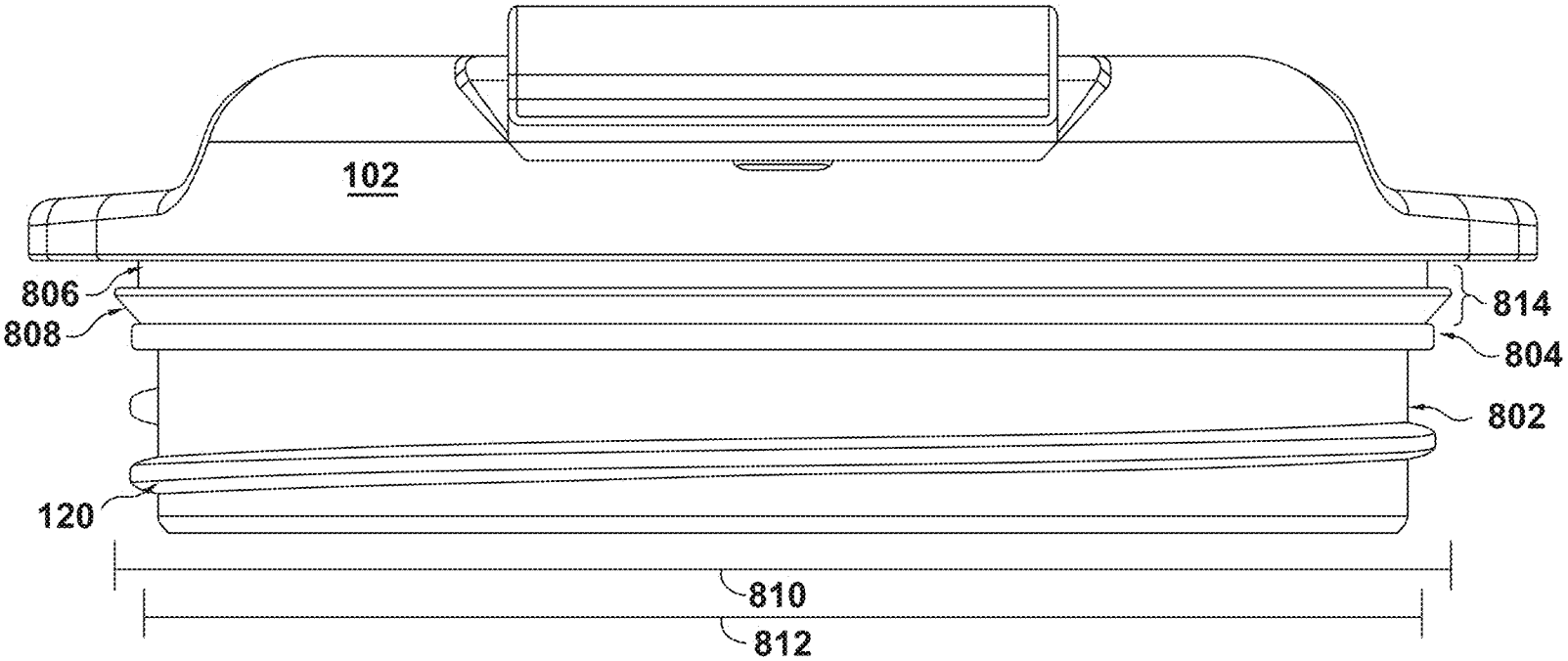
FIG. 8 shows a front view of an embodiment of a lid of the present disclosure, according to at least one embodiment of the present disclosure.
Figure 9:
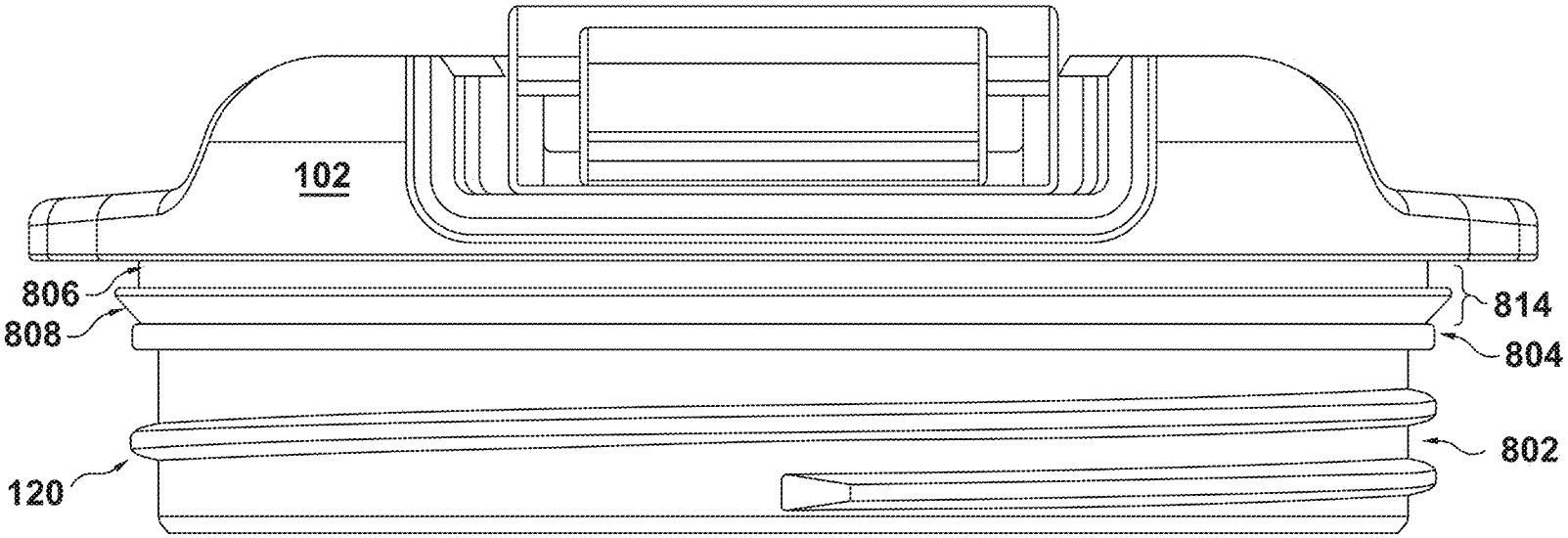
FIG. 9 shows a rear view of an embodiment of a lid of the present disclosure, according to at least one embodiment of the present disclosure.
Figure 10:
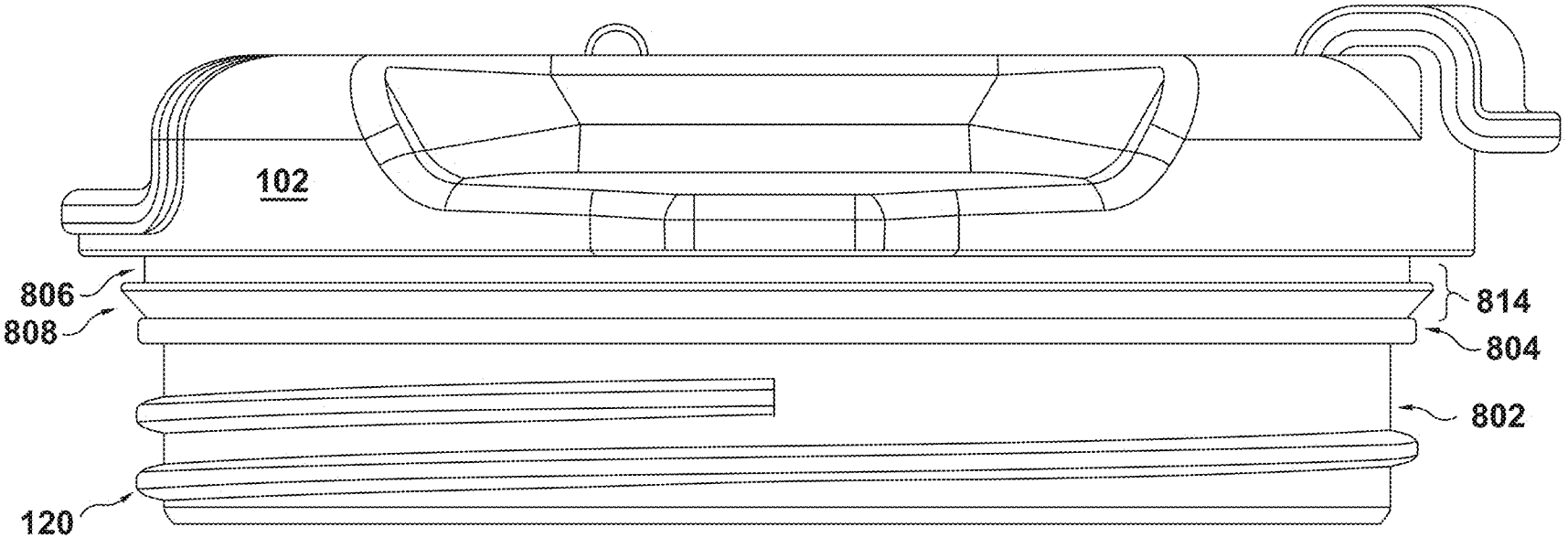
FIG. 10 shows a left side view of an embodiment of a lid of the present disclosure, according to at least one embodiment of the present disclosure.
Figure 11:
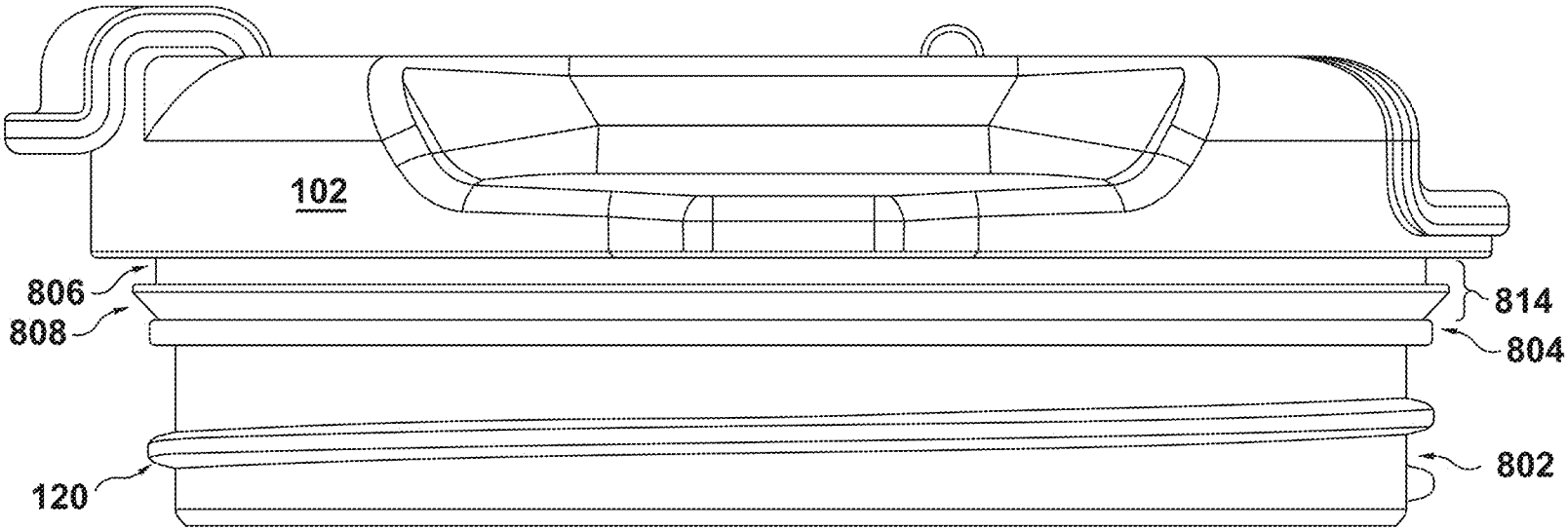
FIG. 11 shows a right side view of an embodiment of a lid of the present disclosure, according to at least one embodiment of the present disclosure.
Figure 12:
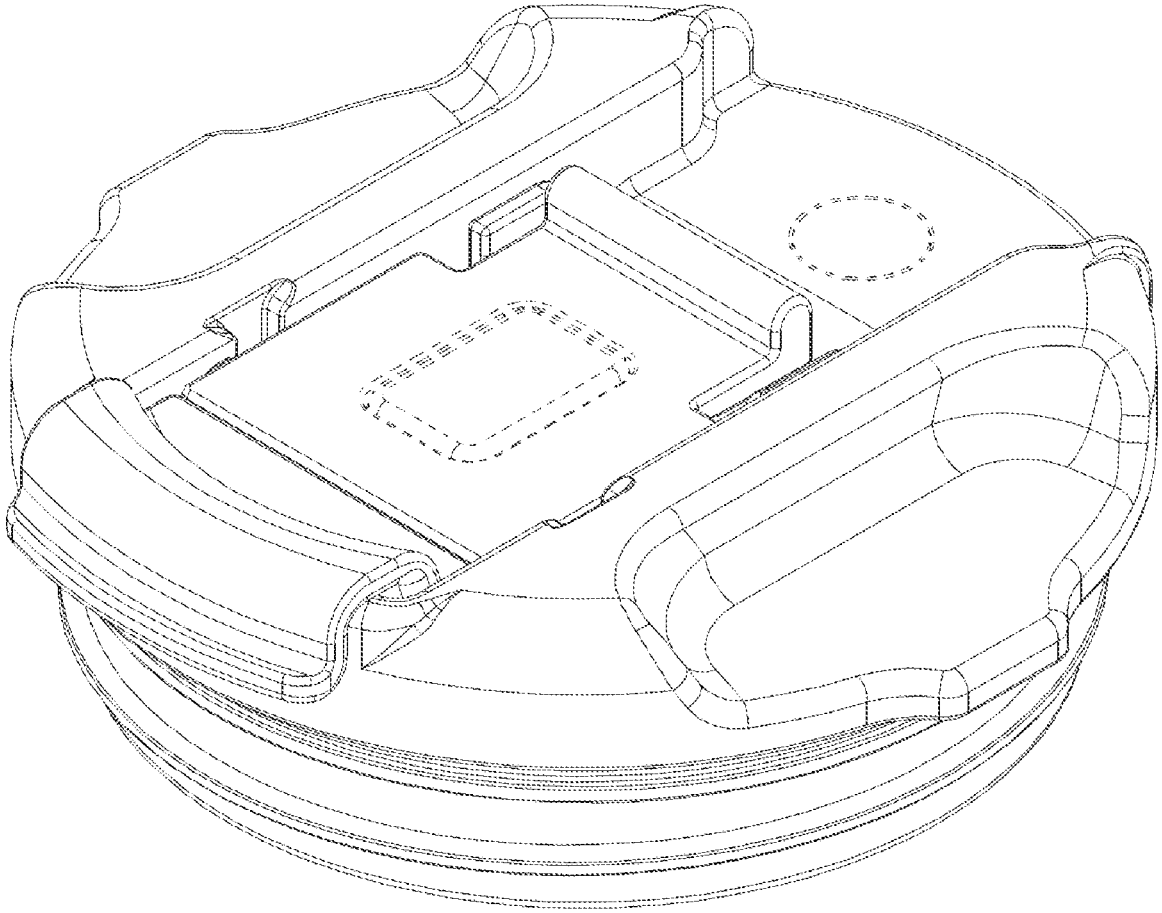
FIG. 12 shows a perspective view of an embodiment of a lid of the present disclosure, according to at least one embodiment of the present disclosure.
Figure 13:
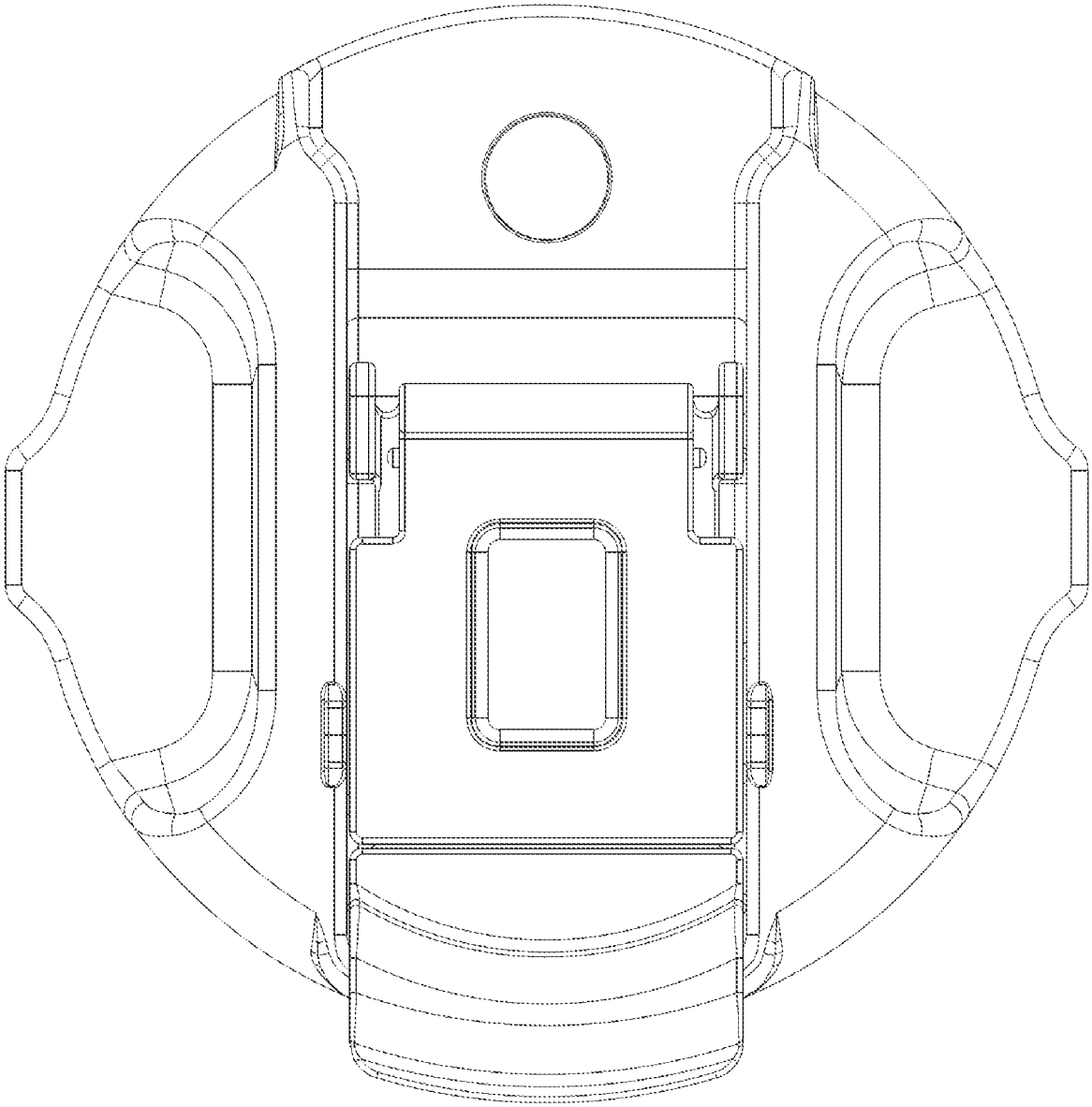
FIG. 13 shows a top view of an embodiment of a lid of the present disclosure, according to at least one embodiment of the present disclosure.
Figure 14:
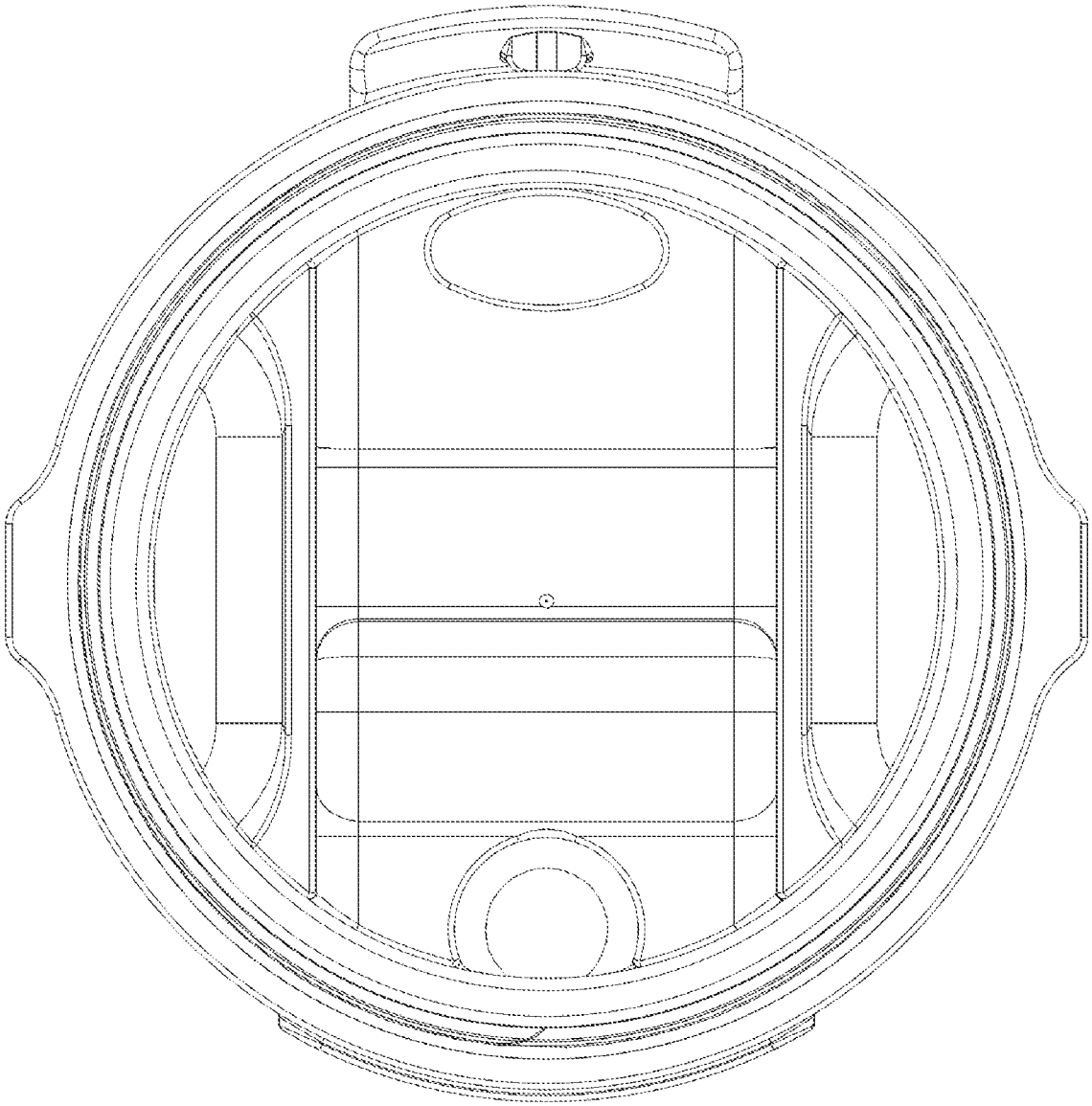
FIG. 14 shows a bottom view of an embodiment of a lid of the present disclosure, according to at least one embodiment of the present disclosure.
Figure 15:
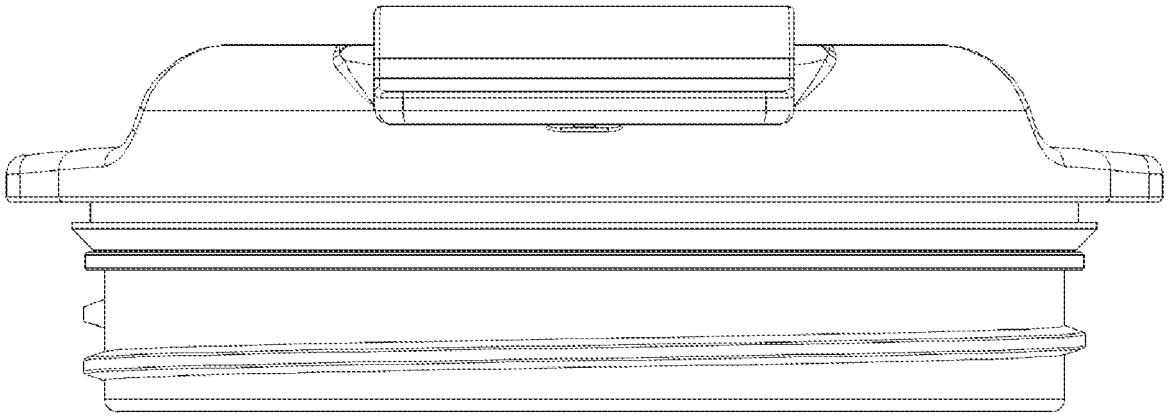
FIG. 15 shows a front view of an embodiment of a lid of the present disclosure, according to at least one embodiment of the present disclosure.
Figure 16:
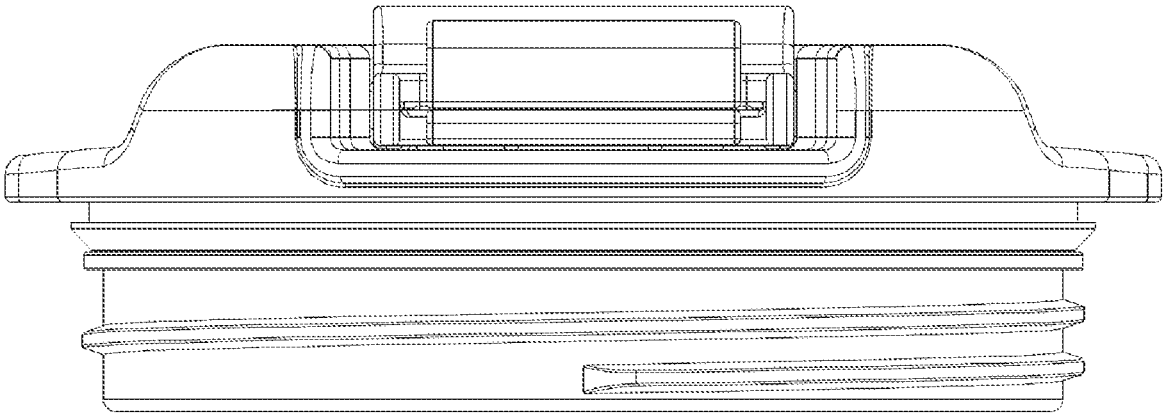
FIG. 16 shows a rear view of an embodiment of a lid of the present disclosure, according to at least one embodiment of the present disclosure.
Figure 17:
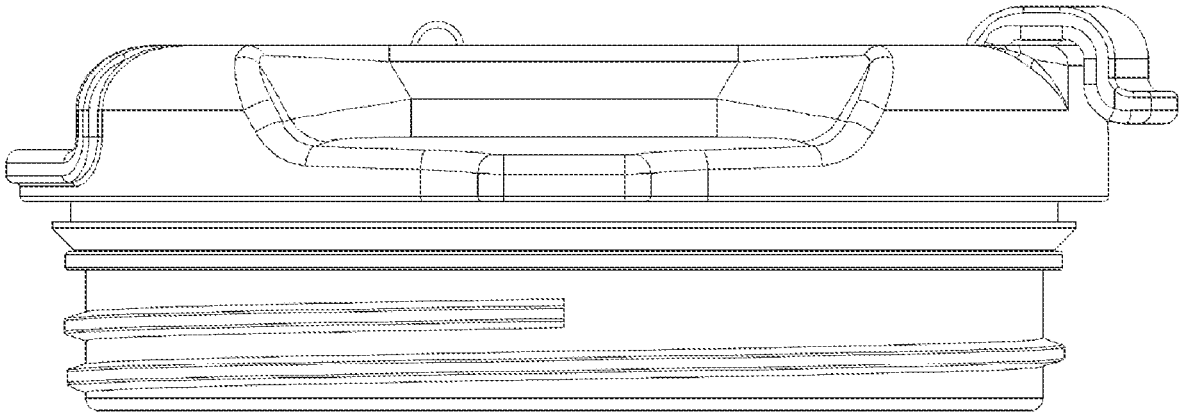
FIG. 17 shows a left side view of an embodiment of a lid of the present disclosure, according to at least one embodiment of the present disclosure.
Figure 18:
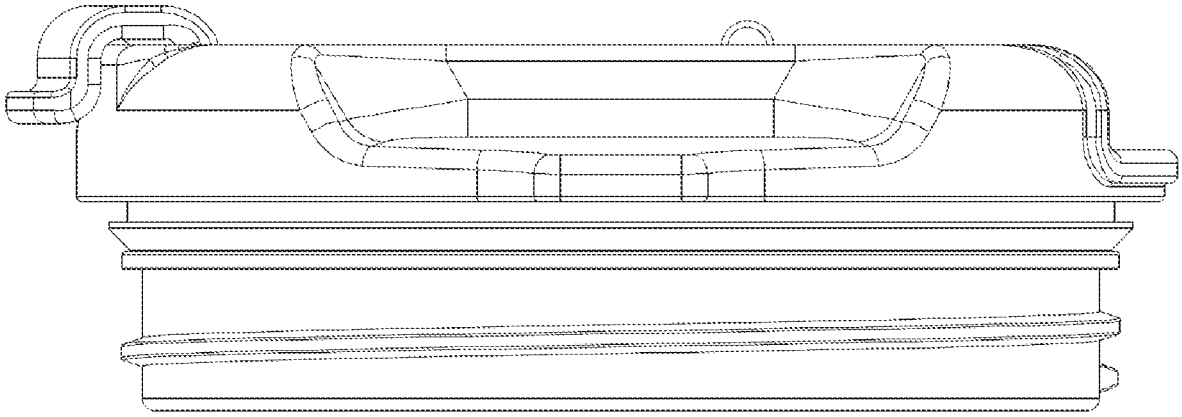
FIG. 18 shows a right side view of an embodiment of a lid of the present disclosure, according to at least one embodiment of the present disclosure.
Figure 19:
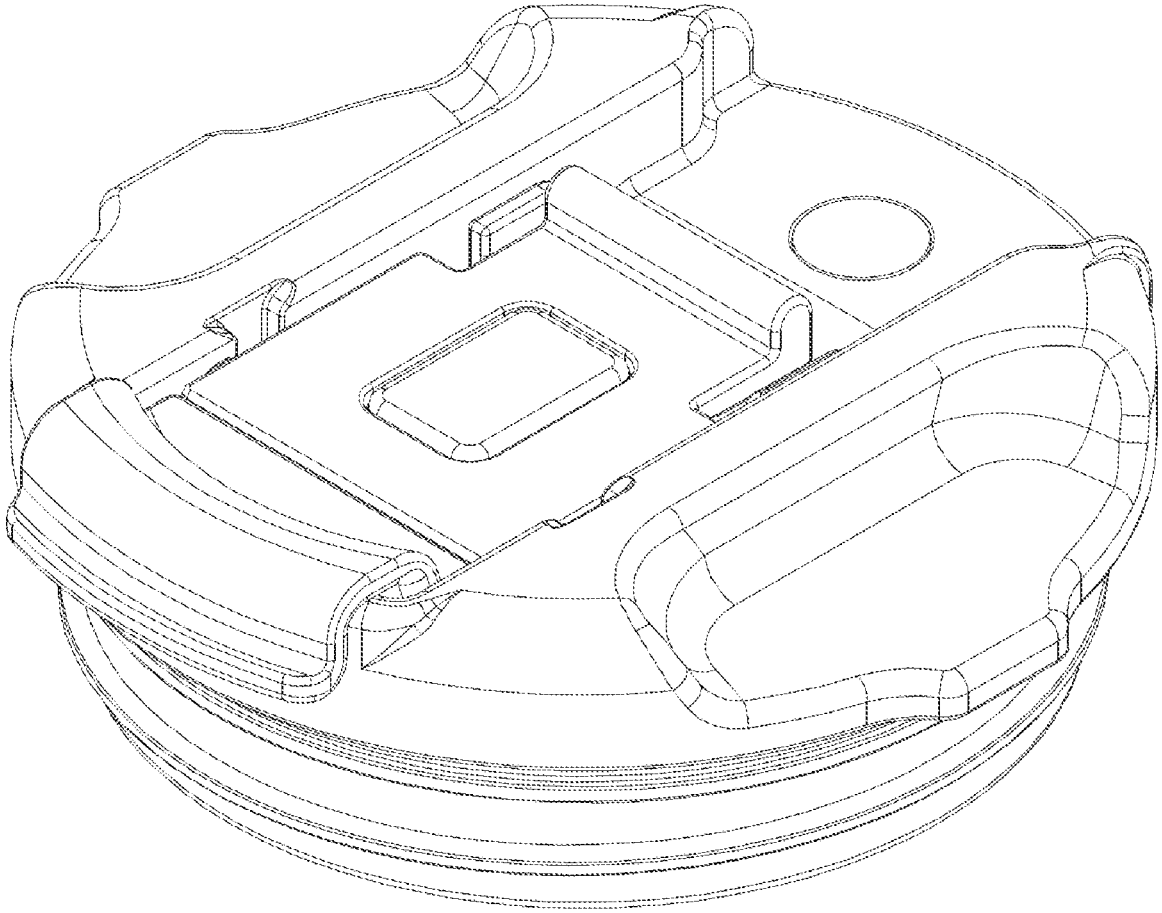
FIG. 19 shows a perspective view of an embodiment of a lid of the present disclosure, according to at least one embodiment of the present disclosure.

In at least some embodiments of the present disclosure, lids 100 have a threaded portion 118 comprising threads 120, such as shown in FIGS. 1, 2, and 3. Threaded portion 118 is configured to engage a complimentary threaded portion of a container 200. In some embodiments, threaded portion 118 only functions so that when lid 100 is twisted in a first direction relative to container 200, lid 100 is tightened relative to container 200, and so that when lid 100 is twisted in a second direction relative to container 200, lid 100 is loosened relative to container 200. In other embodiments, such as shown in FIG. 4, threaded portion 118 is configured with threads 120 that can be positioned relative to container 200 and twisted in either direction so to tighten lid 100 relative to container 200. Such an embodiment would therefore allow a user to, for example drink from container 200 with either hand directly (or indirectly by way of a container 200 with a handle 202, such as shown in FIG. 3), such that the drink opening 500 of lid 100 (such as shown in FIG. 5) is located relative to container 200 to permit a user to drink therefrom while also having lid 100 being tightened relative to container 200. Such a lid 100 configuration may be referred to as being "dual threaded," for example.

FIG. 3 shows additional components/features of various exemplary lids 100 of the present disclosure. As shown therein, an exemplary flip component 106 has a flip lock 502 (discussed in further detail below), with flip lock 502 comprising a lock tab 300 configured to engage an indention 302 defined within lid body 102 when flip component 106 is in a closed configuration relative to lid body 102, further assisting with keeping flip component 106 in a closed configuration. Furthermore, and as shown in FIG. 3, an exemplary lid 100 embodiment of the present disclosure may comprise a stopper 304 coupled to or formed as part of flip component 106, said drink stopper 304 configured (sized and shaped) to fit within drink opening 500 so to seal said drink opening 500 when flip component 106 is in a closed configuration. Additionally, and in various embodiments, lid bodies 102 of the present disclosure can have a vent opening 508 defined therein, such as shown in FIG. 5, allowing an interior of a container 200 to vent while a user is drinking from said container 200 having a lid 100 of the present disclosure coupled thereto. In various embodiments, lids 100 of the present disclosure can comprise a vent stopper 306 coupled to or formed as part of flip component 106, said vent stopper 306 configured (sized and shaped) to fit within vent opening 508 so to seal said vent opening 508 when flip component 106 is in a closed configuration.

FIG. 5 shows an exploded view of components of an exemplary lid 100 of the present disclosure. As shown therein, lid body 102 is configured to hingedly engage flip component 106, and slide component 108 is configured for positioning upon flip component 106 while slidingly engaging lid body 102. As shown in FIG. 5, the flanges 116 extend away from the topside of the lid body 102 on opposite sides of the drink opening 500. Each flange 116 includes a locking channel 115 formed therein. A pair of lock tabs 507 extend away from opposite sides of the slide component 108. A respective lock tab (e.g., one lock tab of the pair of lock tabs 507) is configured to be received in a respective locking channel (e.g., one of the locking channels 115) when the flip component 106 is in the closed configuration. Flip lock 502, as shown in FIG. 5, is a portion of flip component 106 that is configured (sized and shaped) so to engage a portion of lid body 102 when flip component 106 is in a closed configuration relative to lid body 102. Slide component 108 comprises a slide flange 504, such as shown in FIG. 5, which aids a user with sliding said slide component 108 back and forth relative to flip component 106 so to lock and unlock flip component 106 in place relative to lid body.

As referenced herein, when an exemplary lid 100 of the present disclosure is threadably coupled to a container 200, lid 100 itself would not detach from container 200 without being intentionally removed. A seal forms between lid 100 and container 200 by way of a circumferential seal 506, such as shown in FIG. 5, which comprises a compliant material (such as rubber or another compliant material) that somewhat compresses between a relative top of container 200 and an underside of lid 100. Further, when flip component 106 of tab assembly 104 is in a closed configuration relative to lid body 102 (such that flip lock 502 engages a portion of lid body 102), and when slide component 108 is slid in a closed position relative to flip component 106, flip component 106 is locked in place relative to lid body.

In at least some embodiments of the present disclosure, with reference to FIGS. 8, 9, 10, and 11, the lids 100 may have a cylindrical wall 802 extending away from the underside of a lid body (e.g., such as the lid body 102) to a bottom edge. A retaining flange 804 extends radially out from the cylindrical wall 802 at a position intermediate to the underside of the lid body and the bottom edge. The thread 120 extends radially out from the cylindrical wall 802 between the bottom edge and the retaining flange 804. A circumferential seal 814 is coupled to the cylindrical wall 802 between the retaining flange 804 and the underside of the lid body. The circumferential seal 814 has a sleeve portion 806 and a flange portion 808. The flange portion 808 of the circumferential seal 814 extends away from the cylindrical wall 802 and towards the underside of the lid body. The flange portion 808 is configured to move between a first position associated with the lid body being uncoupled from a beverage container and a second position associated with the lid body being coupled to the beverage container. The flange portion 808 is configured to deflect towards the cylindrical wall when in the second position. In some embodiments, the sleeve portion 806 includes a top end positioned adjacent the underside of the lid body and a bottom end opposite the top end. In some embodiments, the flange portion 808 extends from the bottom end of the sleeve portion 806 towards the underside of the lid body. In some embodiments, the top end of the sleeve portion 806 is spaced from the bottom end of the sleeve portion 806 a first distance and the flange portion 808 extends a second distance, the second distance being less than the first distance.

The circumferential seal 814 has a first diameter 810 (e.g., the diameter of the flange portion 808) when in the first position and a second diameter 812 (e.g., the diameter of the sleeve portion 806) when in the second position. In some embodiments, the first diameter 810 is greater than the second diameter 812. In some embodiments, the first diameter 810 is greater than a diameter of the retaining flange 804. In some embodiments, the first diameter 810 is greater than an effective diameter of the threading 120. The effective diameter is the outer diameter of the thread 120. In some embodiments, the first diameter 810 is less than a diameter of the lid body. The sleeve portion 806 has a first height and the flange portion 808 has a second height. In some embodiments, the first height is greater than the second height. In some embodiments, the first height is equal to a distance between the underside of the lid body and the retaining flange 804. The flange portion 808 is configured to have a third height when the lid body is coupled to a beverage container. An internal diameter of the sleeve portion 806 is equal to an outer diameter of the cylindrical wall 802. In some embodiments, the internal diameter of the sleeve portion 806 is less than a diameter of the retaining flange 804.

While various embodiments of lids for beverage containers and methods for using the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

What is claimed is:

1. A beverage container lid, comprising:

a lid body having a topside opposite an underside;

a cylindrical wall extending away from the underside of the lid body to a bottom edge;

a retaining flange extending radially out from the cylindrical wall at a position intermediate to the underside of the lid body and the bottom edge;

a threading extending radially out from the cylindrical wall between the bottom edge and the retaining flange; and a circumferential seal coupled to the cylindrical wall between the retaining flange and the underside of the lid body, the circumferential seal having a sleeve portion and a flange portion, wherein the flange portion extends away from the cylindrical wall and towards the underside of the lid body.

2. The beverage container lid of claim 1, wherein the flange portion of the circumferential seal is configured to move between a first position associated with the lid body being uncoupled from a beverage container and a second position associated with the lid body being coupled to the beverage container.

3. The beverage container lid of claim 2, wherein the flange portion is configured to deflect towards the cylindrical wall when in the second position.

4. The beverage container lid of claim 2, wherein the circumferential seal has a first diameter when in the first position and a second diameter when in the second position, wherein the first diameter is greater than the second diameter.

5. The beverage container lid of claim 4, wherein the first diameter is greater than a diameter of the retaining flange.

6. The beverage container lid of claim 4, wherein the first diameter is greater than an outer diameter of the threading.

7. The beverage container lid of claim 4, wherein the first diameter is less than a diameter of the lid body.

8. The beverage container lid of claim 1, wherein the sleeve portion has a first height and the flange portion has a second height, wherein the first height is greater than the second height.

9. The beverage container lid of claim 8, wherein the first height is equal to a distance between the underside of the lid body and the retaining flange.

10. The beverage container lid of claim 8, wherein the flange portion is configured to have a third height when the lid body is coupled to a beverage container.

11. The beverage container lid of claim 1, wherein an internal diameter of the sleeve portion is equal to an outer diameter of the cylindrical wall.

12. The beverage container lid of claim 11, wherein the internal diameter of the sleeve portion is less than a diameter of the retaining flange.

13. The beverage container lid of claim 1 further comprising a flip component hingedly coupled to the topside of the lid body, the flip component configured to move between a closed configuration and an open configuration.

14. The beverage container lid of claim 13 further comprising a slide component slidably coupled to the flip component, the slide component configured to move between a locked position and an unlocked position.

15. The beverage container lid of claim 14 further comprising a drink opening formed through the lid body.

16. The beverage container lid of claim 15 further comprising a drink stopper extending from the flip component and configured to fit within the drink opening and seal the drink opening when the flip component is in the closed configuration.

17. The beverage container lid of claim 16 further comprising:

a pair of flanges extending away from the topside of the lid body on opposite sides of the drink opening, each flange of the pair of flanges including a locking channel formed therein; and a pair of lock tabs extending from opposite sides of the slide component, a respective lock tab is configured to be received in a respective locking channel when the flip component is in the closed configuration.

18. The beverage container lid of claim 17, wherein the locking channel prevents rotation of the flip component when the slide component is in the locked position and permits rotation of the flip component when the slide component is in the unlocked position.

19. The beverage container lid of claim 14 further comprising a first magnetic portion coupled to the slide component and a second magnetic portion coupled to the top side of the lid body, the first and second magnetic portions configured to hold the flip component in the open configuration.

20. A beverage container lid, comprising:

a lid body having a topside opposite an underside;

a cylindrical wall extending away from the underside of the lid body to a bottom edge;

a retaining flange extending radially out from the cylindrical wall at a position intermediate to the underside of the lid body and the bottom edge;

a threading extending radially out from the cylindrical wall between the bottom edge and the retaining flange; and a circumferential seal coupled to the cylindrical wall between the retaining flange and the underside of the lid body, the circumferential seal having a sleeve portion and a flange portion, wherein the sleeve portion includes a top end positioned adjacent the underside of the lid body and a bottom end opposite the top end, and wherein the flange portion extends from the bottom end of the sleeve portion towards the underside of the lid body, and wherein the top end of the sleeve portion is spaced from the bottom end of the sleeve portion a first distance and the flange portion extends a second distance, the second distance being less than the first distance.

* * * * *